United States Patent [19]

Tamehiro et al.

[11] Patent Number: 4,521,258

[45] Date of Patent: Jun. 4, 1985

[54] METHOD OF MAKING WROUGHT HIGH TENSION STEEL HAVING SUPERIOR LOW TEMPERATURE TOUGHNESS

[75] Inventors: Hiroshi Tamehiro; Hiroo Mazuda; Mamoru Ohashi, all of Kimitsu; Yasumitsu Onoe, Kitakyushu, all of Japan

[73] Assignee: Nippon Steel Corporation, Tokyo, Japan

[21] Appl. No.: 562,250

[22] Filed: Dec. 16, 1983

Related U.S. Application Data

[63] Continuation-in-part of Ser. No. 424,780, Sep. 27, 1982, abandoned.

[30] Foreign Application Priority Data

Oct. 31, 1981 [JP] Japan ..... 56-174950

[51] Int. Cl.[3] ..... C21D 8/02

[52] U.S. Cl. ..... 148/12 F; 148/12.4

[58] Field of Search ..... 148/12 F, 12.4, 36

[56] References Cited

U.S. PATENT DOCUMENTS 4,219,371 8/1980 Nakasugi et al. ..... 148/12 F

*Primary Examiner*—Peter K. Skiff

*Attorney, Agent, or Firm*—Pollock, Vande Sande & Priddy

[57] ABSTRACT

Due to increasing demands for steel to be used for construction such as buildings, pressure vessels, pipe lines or the like, various kinds of high tension steels, particularly steels suitable for welding have increasingly been developed.

Heretofore, proposed methods of making such high tension steel have relied on so-called cold rolling and/or rolling followed by quenching and tempering, however, these conventional steels have suffered from drawbacks such as a tempering step indispensable after quenching, softening of welded zone and lack of uniformity in the metal structure in the direction of plate thickness.

A compositional feature of the new method resides in addition of minor amounts of Ti and B along with Nb as contributing to grain refining or precipitation hardening elements in addition to limited amounts of other ingredients such as C, Si, Mn, S, Al and N.

Further addition of at least one of V, Ni, Cu, Cr, Mo, Ca and REM also acts to improve the properties of the steel.

The steel prepared to have the aforesaid composition is subjected to controlled heating, subsequent rolling under prescribed rolling reduction ratio, temperature for terminating rolling and to a specified cooling rate.

The steel plate thus processed has a structure having fine bainite grains alone or a duplex grain structure consisting of fine bainite and fine ferrite particularly finer toward the surface so as to satisfy both ductility and toughness without tempering operation and displays good weldability and toughness even at a welded zone as well as stable hardness distribution throughout the plate thickness.

10 Claims, 2 Drawing Figures

METHOD OF MAKING WROUGHT HIGH TENSION STEEL HAVING SUPERIOR LOW TEMPERATURE TOUGHNESS

CROSS REFERENCE TO RELATED CASES

The present application is a continuation-in-part of our copending U.S. patent application Ser. No. 424,780, filed Sept. 27, 1982 and entitled "A Method of Making Wrought High Tension Steel Having Superior Low Temperature Toughness", abandoned.

BACKGROUND OF THE INVENTION

1. Field of the Invention

This invention relates to a method of producing steel superior in strength, toughness and weldability by virtue of having been put through controlled rolling combined with controlled cooling.

Recently, various kinds of high tension steel have been used for many welded constructions such as buildings, pressure vesseles, ship building and pipe lines to satisfy economic requirements and safety in use, accordingly, the demand for high tension steels having good weldability has been steadily increasing.

Steel used for welded constructions is required to have high toughness and superior weldability for the sake of safety and good workability in welding operation in addition to high tensile strength.

2. Description of the Prior Art

It is well known that controlled rolling and quenching and tempering methods applied for making line pipes have heretofor been used for making high tension steel which satisfies the above-mentioned requirements.

However, microstructure obtained by the former method is of two phase structure consisting of ferrite and pearlite, so there exists limitation with respect to the strength and the thickness of the rolled products.

In other words, large amounts of alloying elements have to be added in order that the steel having acicular ferrite or bainite structure can be obtained.

On the other hand, the latter method requires at least a reheating step which gives rise to high production costs and further has limitation due to production capacity.

In view of these drawbacks, a more advanced method of controlled cooling is being developed which enables saving of energy and natural resources, that is, lowering addition of alloying elements.

Steels obtained by this improved method display the features of the steel obtained through both the controlled rolling method (hereinafter referred to as CR method) and the quenching and tempering method (hereinafter referred to as QT method) and are able to provide superior properties with either low addition of alloying elements or even without addition of any special alloying element or elements.

However, those steels manufactured by the conventional methods still have suffered from several drawbacks as mentioned below.

(1) A tempering step is indispensable for a steel which has been subjected to quenching after rolling, so as to restore the ductility and toughness lowered by the quenching.

(2) Since the extent of softening at the heat affected zone (HAZ) of the steel due to welding is remarkably large, it is very difficult, particularly for high yield point steels or high tension steels, to ensure required strength.

(3) Microstructure of the steel in the direction of its thickness is nonuniform and has large extent of hardness variation.

(4) Condition of cooling (temperature of starting and stopping the cooling and the rate of cooling) must be controlled in a very strict manner, thus it is liable to cause undesired variations in the property of the product steel.

Due to these drawbacks, steels manufactured in accordance with the conventional controlled cooling method have been applied only for very restricted uses and also due to the difficulty for making on a mass production scale, they have not been widely used to up to the present.

With an intention to obviate aforesaid defects, the inventors of the present invention carefully studied various factors such as chemical composition of the steel to be used well as a condition of heating, rolling and the manner of cooling the steel.

As a result, the inventors have developed a novel method of making a series of high toughness steels accomplished by combining low temperature heating followed by controlled cooling and have filed two prior patent applications in Japan, their Patent Laid-open Nos. are 131125/80 and 76126/82.

Through further studies and experiments, the inventions have also found an entirely new method of making steels other than those disclosed by the above-mentioned prior inventions.

SUMMARY OF THE INVENTION

It is, accordingly, an object of the present invention to obviate the drawbacks in the prior art methods and to provide a novel method of making high tension steel having, due to its micro structure, good ductility and toughness by adding comparatively lower amounts of alloying elements and without necessitating a tempering operation.

Another object of the present invention is to provide a method of making high tension steel which displays improved hardenability even at a welded zone.

It is a further object of the present invention to provide a method of making high tension steel which has uniform hardness distribution throughout the direction of the thickness of the steel.

Other objects and advantages of the present invention will become apparent from the following description and appended claims.

The distinguishable features of this invention reside in the addition of small amount of Ti and B combined with the effective addition of niobium (Nb) as a grain refining and precipitation hardening element.

This combined addition of Nb, B and Ti together with controlled rolling and cooling provide synergistic enhancement of a balance between the strength and toughness of the obtained steel.

Although boron is well known as an element for increasing hardenability of steel, a mere levelling up of hardenability alone relying on the addition of boron (B) does not result in superior strength accompanying good toughness.

Due to this reason, small amount of Ti and Nb are added in combination. Ti in a steel acts to fix nitrogen (N) in the steel and stabilize the boron's effect of increasing hardenability, and at the same time, fine particles of TiN are formed being in combination with N and act to retard grain growth of austenite particles during its heating and rolling and cause grains of ferrite phase to become very fine.

Nb, as is well know, is apt to retard or prevent recrystallization of austenite grains during lower temperature rolling (less than about 950° C.), thereby increasing the transformation ratio $\gamma/\alpha$ and making the rolled structure finer.

In addition, Nb in solid solution is known to segregate at austenite grain boundaries thereby enhancing the hardenability of the steel.

The inventors, however, found that a new effect could be brought about if B and Nb coexist in a steel. In other words, if the temperature below which austenite grain maintains its non-recrystallized state (the same as the recrystallization temperature) is elevated by about 50° C. together with remarkable increase in hardenability (about one and a half times), then the increase in balance between strength and toughness, namely, strength/toughness value could be greatly increased far beyond the extent expected from those steels containing only either one of Nb and B.

It was also found that the above-mentioned improvement could be obtained to a greater extent than would be by either a conventional heat treatment or a sole controlled rolling method.

According to the present invention, four drawbacks encountered in the conventional controlled cooling method as mentioned in items (1) to (4) in the earlier part of this specification can be entirely eliminated.

Now, explanation on these aspects will be made item by item as follows:

Re: drawbacks (1)

The microscopic structure of the steel becomes either that having grains of fine upper bainite alone or duplex grain structure consisting of fine upper bainite and fine ferrite, accordingly the steel displays good ductility and toughness without having to be subjected to tempering.

Re: drawbacks (2)

By virtue of the synergistic effect imparted by Nb and B, hardenability of the steel can be improved even at the welded zone, so the strength of the weld portion also can be secured satisfactory.

Re: drawbacks (3)

Due to grain refinement and improved hardenability given by the synergistic effect of Nb and B, the steel has stable hardness distribution regardless of the cooling speed and thickness of the steel plate.

Moreover, since the steel is subject to rolling at a lower temperature in non-recrystallization range below 900° C. and with rolling reduction of more than 60%, the austenite grains of the steel become finer and finer from interior toward the surface of the steel such that the steel becomes less hardenable from inside toward its surface giving rise to be uniform as-quenched microstructure throughout its thickness.

Re: drawbacks (4)

Due to the refinement of austenite grains and stabilized hardenability, the steel can display stable balance between strength and toughness under a wide range of operating conditions of heating, rolling and cooling.

The steel produced in accordance with the present invention has superior strength and toughness with lower alloying elements, that is, lower carbon equivalency as compared with the conventional steels, so it is less sensitive to hardening and crack formation in welding and has very high toughness at welded portions.

Accordingly, the steel of this invention is satisfactorily applicable to various kinds of use, such as buildings, pressure vessels, ship building and pipe lines.

In particular, the present invention is concerned with a method of making wrought high tension steel having superior strength, toughness and weldability, which comprising the steps of:

preparing a steel consisting essentially by weight of; 0.005–0.12% C, not more than 0.6% Si, 0.6–2.2% Mn, not more than 0.005% S, 0.005–0.08% Al, 0.01–0.08% Nb, 0.0005–0.002% B, 0.004–0.03 Ti, not more than 0.006% N and the remainder being Fe and incidental impurities and the Ti and N contained in the steel satisfy the relationship expressed by a formula $$-0.01\% \leqq Ti - 3.4N \leqq 0.02\%;$$

heating the steel at a temperature within a range of 1,000°–1,200° C.;

rolling the steel with a rolling reduction of not less than 60% at a temperature range of not more than 900° C. and the temperature for terminating the rolling is kept within a range of 640°–850° C.;

cooling the steel after it has been rolled down to a predetermined temperatue lower than 550° C. with a cooling rate within a range of 10°–40° C./sec.

DESCRIPTION OF BEST AND VARIOUS MODES FOR CARRYING OUT INVENTION

Figure 1:
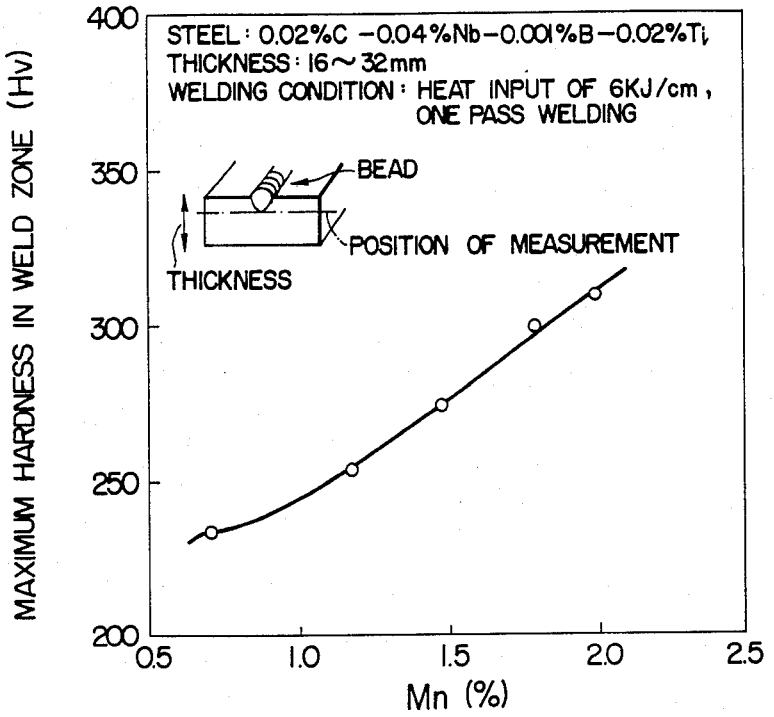
FIG. 1 illustrates the influence of manganese upon hardness of the weld zone.

Hereinafter, explanation will be made in detail on the reasons for restricting the conditions of heating, rolling and cooling.

The reason why the temperature for heating has been set forth as 1000°–1200° C. is to maintain the austenite grain size as small as possible during the heating so as to accomplish grain refinement of the steel when rolled.

1200° C. is the upper temperature limit for preventing excessive coarsening of austenite grains during heating, if the steel is heated above this temperature, austenite grains are partially coarsened which gives rise to coarsening of the upper bainite structure when the steel has been cooled, and thus remarkably deteriorates the toughness of the steel.

On the other hand, if the heating temperature is too low, alloying elements such as Nb and V which participate in precipitation hardening cannot fully be solutionized, thereby not only the balance of strength/toughness of the steel is lowered, but also the improved property of the steel to be accomplished by the controlled cooling cannot fully be obtained due partly to degraded property of the steel and partly to the too lowered temperature of the steel at the final stage of rolling.

Consequently, lower limit of the temperature for heating must not be lowered below 1000° C.

Even if the heating temperature is maintained within a lower range as mentioned above, steel of desired good properties cannot be obtained unless the condition of rolling is also suitably followed.

For this reason, extent of rolling reduction in the non-recrystallization temperature zone below 900° C. must be maintained above 60%, and the finishing temperature must be kept within a range of 640°–850° C.

The object of setting forth the above-mentioned rolling condition is to impart sufficient rolling reduction in the non-recrystallization range so as to accomplish refinement and elongation of austenite grains and thereby to ensure fine and uniform transformation structure to be formed when the hot rolled steel has been cooled.

By virtue of fully refining grains of ferrite and upper bainite, which can be done only when the austenite grains of the steel have previously been refined, elongated by rolling and then subjected to hot rolling and cooling, toughness of the steel can be greatly improved.

If, however, the temperature for terminating the hot rolling is not maintained suitably, the desired strength and toughness of the steel cannot be guaranteed.

The reason for deciding on a lower temperature range for terminating hot rolling such as 640° C. is based on the consideration so as not to degrade ductility and toughness of the steel by conducting rolling at the region of ($\gamma$ plus $\alpha$) below the transformation temperature of the steel. Also it is difficult to attain sufficient increase in strength of the steel by means of controlled cooling, if the hot rolling is terminated at a temperature lower than 640° C.

On the other hand, if the temperature for terminating the rolling is too high, the grain refinement through the controlled rolling can not be accomplished, thus resulting in lowering of the toughness of the steel so that upper limit must be kept not to exceed 850° C.

Next, the manner of cooling subsequent to rolling will be discussed, in order that both satisfactory strength and toughness can be obtained, cooling must be performed so that the rolled steel has uniform transformed structure throughout the thickness direction of the steel.

According to the present invention, cooling of the steel from the termination of rolling down to a predetermined temperature less than 550° C. and preferably less than 550° C. to about 350° C. is required to be done at a cooling rate of 10°–40° C./sec.

The reason for setting forth the above cooling rate is that bainite structure cannot be formed by a slow cooling rate of less than 15° C./sec. and thus gives rise to an insufficient increase in strength.

On the other hand, a number of island-like hard martensite grains will form by such a rapid cooling as with a cooling rate of above 40° C./sec. and thereby degrade the ductibility and toughness of the steel.

The reason why the temperature for terminating cooling of the rolled steel has been set forth as a predetermined temperature less than 550° C. is based upon the fact that cooling of the steel down to an excessively low temperature tends to result in insufficient hydrogenation and precipitation hardening of the steel.

In the preferred aspects of the present invention, the accelerated cooling is carried out in the range of below 550° C. to about 350° C. Below about 350° C. the cooling is preferably air-cooling. In the event the removal of hydrogen is not sufficient, micro-crackings due to hydrogen can occur in the steel plate after cooling with the result that such steel plate can not be used. Moreover, if the precipitation hardening is not sufficient, the added elements are wasted away. By ceasing the accelerated cooling to about 350° C. and effecting air-cooling thereafter, the diffusion of hydrogen is facilitated thereby assuring that the hydrogen remaining in the steel plate is substantially reduced, providing for the production of sound and flawless steel plate.

However, if the temperature for terminating the cooling is set above 550° C., sufficient increase of the strength cannot be obtained.

In particular, with the steel of the present invention, bainite transformation occurs below about 550° C.

Accordingly, by effecting accelerated cooling below 550° C., the amount of bainite in the microstructure increases and the structure becomes also fined in crystal grain size so that the balance of strength and toughness is improved. If the accelerated cooling is ceased at a temperature above 550° C., the above advantages of the present invention are not achieved.

Generally, water or water jet is a suitable cooling medium. When reheating is required for the steel produced in accordance with the invention for the purpose of dehydrogenation or the like, heating temperature of above 600° C. is not adequate because it will reduce the strength, but reheating at a temperature lower than 600° C. may bring about a minor extent of hardness decrease, but will not substantially impair the feature of the present invention.

Explanation will now be made on the reasons for setting forth the chemical composition range for each of the ingredients.

The chemical composition of the steel in accordance with the present invention by weight, is as follows:

C: 0.005–0.12%, Si: not more than 0.6%,
Mn: 0.6–2.2%, S: not more than 0.005%,
Al: 0.005–0.08%, Nb: 0.01–0.08%, B: 0.005–0.002%, Ti: 0.004–0.03%, N: not more than 0.006%, and further, the Ti and N in the steel satisfies the formula: $-0.01\% \leqq Ti - 3.4N \leqq 0.02\%$.

The lower limit of 0.005% for carbon is a minimum amount for securing the strength of both the base metal and the welded zone and also for forming sufficient amounts of carbide or carbides combined with carbide-forming elements such as Nb and V in order to display precipitation hardening effect sufficiently.

However, excessive amounts of carbon, if added, will form grains of band-shaped island-like martensite, when the steel is subjected to controlled cooling thereby not only exerting undesirable effect on the ductility and toughness, but also degrading the weldability of the steel.

Due to these reasons, the upper limit of carbon is specified as 0.12%. Si is an element inevitably contained by addition for the purpose of oxidization, but it has an adverse effect on the weldability and toughess at HAZ, so the upper limit of Si is specified as 0.6%.

Since oxidation of the steel can be done relying merely on Si, the content of Si is preferably kept not more than 0.2%.

Mn in the present invention enhances the effects obtained by the combined controlled rolling-controlled cooling for enhancing properties of the steel, particularly, both the strength and ductility, so it is a very important element in the present invention.

Less than 0.6% of Mn lowers the strength and toughness of the steel, so the lower limit for Mn has been set forth as 0.6%.

On the other hand, amounts of Mn in excess increase hardenability of the steel too much and thus resulting in a large amount of bainite grains of island-like martensite grains, which deteriorate weldability of the steel and lower toughness of the base metal and welded zone of the steel.

In this respect, upper limit for Mn content has been set forth to be 2.2%. The preferred upper amount for the Mn content is 1.4%. In accordance with the present invention, the strength of the steel is improved by the addition of niobium and boron in conjunction with the use of the accelerated cooling after the controlled cooling. Accordingly, sufficient strength can be maintained even when using a relatively low manganese content such as 0.6–1.4%. This is important since, in general, although manganese is an element effective for improving the strength of the steel, the carbon equivalent becomes large by the addition of manganese. This, in turn, results in both the weldability of the steel and the low temperature toughness in weld zone becoming degraded as the content of manganese increases.

Figure 2:
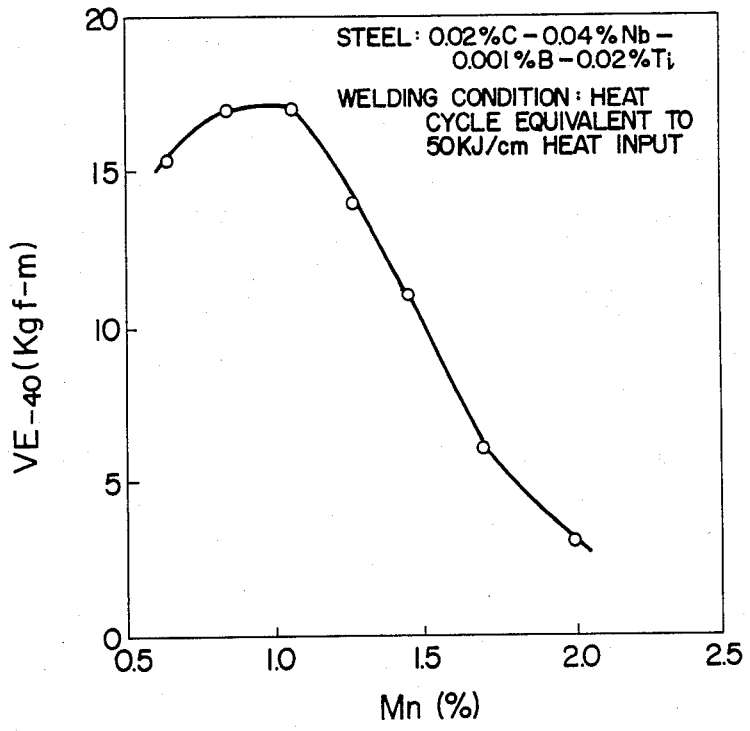
FIG. 2 illustrates the influence of manganese upon the toughness of weld heat-affected zone.

Reference is made to FIGS. 1 and 2 to illustrate the importance of limiting the manganese content and especially limiting it to the preferred amount of 0.6 to 1.4%. FIG. 1 shows the influence of manganese upon the hardness of the weld zone which is one of the criteria for judging the weldability. FIG. 2 shows the influence of manganese upon the toughness of weld heat-affected zone. The reasons why the hardness of the weld zone becomes high with the toughness of the weld heat affected zone being deteriorated when the content of manganese in the steel increases, reside in the increase in low temperature transformation products (i.e. martensite and bainite) in the microstructure of the steel.

Further, in a case of producing steel plate by use of a slab obtained through a continuous casting method, manganese is apt to segregate in the center of the steel plate which segregation causes a hardened structure (martensite and bainite) with the result that the resistance to hydrogen induced cracking is extremely deteriorated when a relatively large amount of manganese is added.

The main reason for limiting the content of S as an impurity to be 0.005% is to improve the physical property of the steel.

Generally, as the strength of a steel increases, its ductility and toughness (represented by elongation and charpy energy absorption value of the steel) decreases, also due to the controlled cooling, dehydrogenation of the steel becomes liable to be insufficient to cause some internal defects attributable to MnS in the steel.

However, this can be improved by decreasing absolute amounts of S in a steel, that is, by lowering the S content to not more than 0.005%, remarkable improvement has been observed in the interior property of the steel.

The lower the content of S, the larger is the effect of the improvement, at any rate, greater improvement can be obtained by limiting S content to not more than 0.001%.

In the steel of this invention, P is also contained as an impurity, normally less than 0.030%, and the smaller the contained S is, the greater becomes the improvement in the toughness of the base metal and welded zone as well as weldability and the property of the steel (preferably not more than 0.010%).

Al is also an element inevitably included in this kind of steel for the purpose of deoxidization.

If the content of Al is less than 0.005% sufficient deoxidizing can not be attained and the toughness of the steel is deteriorated, in this regard, the lower limit of the Al content has been set at 0.005%.

On the other hand, Al in excess of 0.08% degrades the cleanliness and HAZ toughness of the steel, so the upper limit of Al was set as 0.08%.

Both Nb and B are elements indispensable for the present invention as they accomplish synergistic effect as mentioned above in enhancing the strength and toughness of the steel.

Nb is added to accomplish grain refinement of the rolled structure of the steel, so that the improvement in hardenability and precipitation hardening to take place such that both the strength and ductibility of the steel can be improved, however, addition of Nb in excess of 0.08% to the steel to be subjected to the controlled cooling does not contribute to any further improvement to the steel and it is rather harmful to the weldability and HAZ toughness, consequently, the upper limit of Nb has been set at 0.08%. The lower limit of 0.01% Nb is the minimum amount which can bring about appreciable effect on improving the property of the steel.

Boron (B) is apt to segregate at the grain boundaries of austenite during the period of rolling thereby causing the steel to take bainite structure, but addition of boron less than 0.0005% does not bring about any appreciable effect on improving hardenability, while boron in escess of 0.002% rather is apt to form BN or boron constituent(s) and degrades the toughness of the base metal and HAZ of the steel. In this regard, both the lower and upper limit of B have been specified to be 0.0005% and 0.002%, respectively.

Addition of Ti, within a range of smaller amount, say (Ti: 0.004–0.03%) forms fine particles of TiN and is effective for grain refinement of both the rolled structure and HAZ of the steel.

In the present invention, Ti also acts to fix nitrogen in the steel and protects the boron's function to improve hardenability of the steel, so it is considered a very important element for this invention.

The lower limit of 0.004% to the addition of Ti is the minimum value which can accomplish improvement in the property of the steel, while an upper limit of Ti was set to be 0.03% by taking the conditions which allow fine particles of TiN to be formed by ordinary production procedure and does not result in lowering of the toughness due to formation of TiC in the steel.

N is also inevitably introduced into a molten steel and lowers the toughness of the steel.

Particularly, large amounts of free N are apt to form island-like martensite grains at HAZ of the welded steel and greatly deteriorate the HAZ toughness.

With the intention to improve toughness both at the HAZ and base metal of the steel, Ti is added as already mentioned, but when N exists more than 0.006% the grain size of TiN particles in the steel become large resulting in lowering of the effect of TiN, so the upper limit of N was set at 0.006%.

According to the present invention, the total of the Ti and N is further restricted to satisfy the formula;

$$-0.01\% \leqq Ti - 3.4N \leqq 0.02\%$$

The reason for setting forth the above condition is to sufficiently fix N with the aid of Ti and thereby to allow B to display the function improving hardenability of the steel.

The upper limit of 0.02% was set such that excessive amounts of Ti will never form to avoid resultant formation of large amounts of TiC leading to the lowering of the toughness, while the lower limit of −0.01% was set forth to prevent excessive amounts of free N from existing to form BN particles which also lower hardenability.

The steel in a second embodiment of the present invention further comprises in addition to the composition of the first embodiment one or more of additives selected from the group consisting of;

V: 0.01–0.08%, Ni: 0.1–1.0%, Cu: 0.1–1.0%,

Cr: 0.1–1.0%, MO: 0.05–0.30%.

The main object of adding these elements resides in that the addition enables improvement in strength and toughness as well as expanding the thickness of the steel plate to be manufactured without impairing the feature of this invention, in this regard, the amount of addition of these elements shall be limited as a matter of course.

V has almost the same effect as Nb, but addition of V less than 0.01% does not bring about any substantial favourable effect, while the upper limit can be tolerated up to 0.08%.

Ni acts to improve strength and toughness of the base metal of the steel without adversely affecting the hardenability and toughness of the steel.

Since addition of less than 0.1% of Ni results in no substantial effect and the addition of Ni over 1% brings about undesirable results on the hardening of HAZ and toughness of the steel, in this respect, lower and upper limits for Ni were set forth to be 0.1% and 1.0%, respectively.

Cu imparts almost the same effect as Ni does, in addition, Cu is effective for withstanding hydrogen induced cracking.

However, less than 0.1% of Cu does not bring forth any appreciable meritorious effect, while addition of Cu over 1.0 will result in so-called copper-cracking during the rolling even when the steel has Ni addition and renders the production very difficults.

In this regard, upper and lower limits for Cu addition have been set as 0.1% and 1.0% respectively.

Addition of Cr generally exerts favourable influence on the strength of the base metal and on the property for withstanding hydrogen induced cracking, but the addition of less than 0.1% Cr does not bring about any appreciable effect, while when the added amount of Cr exceeds 1.0% it excessively increases hardenability of the HAZ and remarkably decreases the toughness and weldability of the steel.

In view of these facts, a lower and an upper limit of Cr in the steel have been specified as 0.1% and 1.0%, respectively.

Mo is known to be an element effective for improving both the strength and toughness of the steel, however, no substantial improvements can be expected from the addition of less than 0.05%, while the addition of Mo in large amounts, say, more than 0.3%, would excessively increase hardenability of the steel as Cr does such that it degrades toughness of both the base metal and HAZ as well as weldability. This is the reason why a lower limit and an upper limit of Mo have been set forth as 0.05% and 0.3%, respectively.

Ca and REM (Rare Earth Metal) tend to spheroidize MnS particles and to improve Charpy energy absorption impact value, in addition they prevent internal defects attributable to rolled and elongated MnS and to hydrogen entrapped in the steel from occurring.

As to the content of REM, addition thereof of less than 0.001% does not result in any actual effect, while the amount exceeding 0.03% will result in the formation of large amount of REM-S or REM-O-S type large size nonmetallic inclusions and impair not only the toughness but also the cleanliness of the produced steel and further adversely affect the weldability.

In this respect, the upper limit of REM was set as 0.03%.

Ca affects in a manner similar to REM and its effective composition range was set as 0.0005%–0.005%.

Several examples of the present invention will be explained hereunder.

Several melts of cast billets produced by a combined converter—continuous casting method were rolled under several different conditions into plates having thickness of 16 to 32 mm.

Mechanical property of the base metal and welded portion of these example steel plates and steel plates for comparison are shown in Table 1.

As can be clearly seen from the table, all the steel plates produced in accordance with the present invention have superior mechanical property both at the base metal and welded portion, while the steel plates for comparison are not satisfactory either at the base metal or at the welded portion and lack balance in properties required for steel plates intended for welded constructions.

Among the steel plates for comparison Heat Nos 9, 10 and 11 are not added with any one of Nb, B and Ti which are indispensable for the steel of the present invention.

Due to this lack of addition, Heat No. 9 consists of coarse grains and is inferior in the toughness of base metal, while plates of Heat Nos. 10 and 11 are not favourably aided by the combined effect of Nb and B and also inferior in the stength of the base metal.

In addition, Heat No. 11 has a coarsened structure at HAZ and also inferior in the toughness of the welded portion.

On the other hand steels of the present invention exhibit superior strength higher than 70 Kg/mm$^2$.

Steels of Heat Nos. 12 and 13 have the same chemical composition as that of Heat No. 1, however, the Heat No. 12 is lower in strength due to the fact that dissolved Nb was insufficient since the temperature of heating was too low, while the Heat No. 13 has less extent of improvement in strength due to its too low cooling speed.

Although Heat No. 14 has the same chemical composition as Heat No. 7 of the present invention, due to lower extent of rolling reduction at the temperature range below 900° C., crystal grains of the steel have been coarsened and it was inferior in the toughness of the base metal.

When the steels of Heat Nos. 1–8 according to the present invention are placed under comparison with the steels of Heat Nos. 9–14, tensile strength of the former group lies within the range of 59.1–81.1 Kg/mm$^2$, particularly, Heat Nos. 5–8 added with one or more of V, Mo, Ni, Cu and REM displayed very high strength ranging from 72.8–81.1 Kg/mm$^2$ which is considerably higher than those of Heat Nos. 9–14 in the range of 56.2–74.2 Kg/mm$^2$.

As to yield strength, steels of Heat Nos. 1–8 showed superior value of 40.7–59.7 Kg/mm$^2$, particularly, those of the Heat Nos. 5–8 displayed higher and more narrow range of yield strength of 52.4–59.4 Kg/mm$^2$ than the values of 38.4–54.4 Kg/mm$^2$ of steels of Heat Nos. 9–14.

With regard to low temperature toughness represented by 2vE-40, all the steels of Heat Nos. 1–8 revealed stable and superior toughness value of 18.0–39.3

Kg-m, which those of Heat Nos. 9–14 lie within a wide range of 4.1–36.9 Kg-m, amoung which Heat Nos. 9 and 14 showed inferior values of less than 5 Kg-m.

Moreover, it is to be noted that the physical property of the transient temperature from ductile to brittle fracture of the inventive steels lie under −100° C. except Heat No. 3 which showed slightly lower value of −95° C.

On the other hand, steels of Heat Nos. 9 and 14 showed values of −50° C. and −80° C. being considerably inferior to the aimed value of −100° C.

With respect to the vE-20 at HAZ as an index for indicating the property of a steel at its welded zone, steels of Heat Nos. 1–8 lie within a range of 18.2 Kg-m (Heat No. 8) to 32.1 Kg-m (Heat No. 3), while the steels for comparison (Nos. 9–14) lie in a wider range from the lower value of 8.2 Kg-m (No. 11) up to 29.1 Kg-m (Heat No. 12) and are lower in reliability as compared with the steels produced in accordance with the present invention.

The steels of the present invention bear superior and stable characteristics with respect to all of the features of strength, toughness, the transition temperature from ductile to brittleness, low temperature Charpy impact test value and toughness at welded portion, particularly, steels added with one or more of V, Mo, Ni, Cu and REM can be remarkably improved in their strength.

TABLE

| | | Chemical composition (% by weight) | | | | | | | | | | |
|---|---|---|---|---|---|---|---|---|---|---|---|---|
| | Heat No. | C 0.005~0.12 | Si <6.6 | Mn 0.6~2.2 | S <0.005 | Nb 0.01~0.08 | Ti 0.004~0.03 | B (ppm) 0.0005~0.002 | Al 0.005~0.08 | N (ppm) <0.006 | Other elements | Value of Tl-3.4N |
| Inventive steel | 1 | 0.02 | 0.26 | 1.52 | 0.001 | 0.043 | 0.022 | 11 | 0.023 | 45 | — | 0.007 |
| | 2 | 0.05 | 0.05 | 1.37 | 0.002 | 0.033 | 0.028 | 9 | 0.033 | 33 | — | 0.017 |
| | 3 | 0.05 | 0.25 | 0.87 | 0.001 | 0.050 | 0.007 | 14 | 0.041 | 12 | Ca 0.0024 Cr 0.18 | 0.003 |
| | 4 | 0.10 | 0.36 | 1.76 | 0.004 | 0.028 | 0.018 | 18 | 0.014 | 40 | — | 0.004 |
| | 5 | 0.03 | 0.21 | 2.01 | 0.002 | 0.032 | 0.021 | 9 | 0.033 | 24 | V 0.053 | 0.013 |
| | 6 | " | " | " | " | " | " | " | " | " | V 0.053 Mo 0.11 | " |
| | 7 | 0.03 | 0.30 | 2.07 | 0.002 | 0.025 | 0.016 | 11 | 0.024 | 64 | Ni 0.28, Cu 0.16 Mo 0.12 | −0.006 |
| | 8 | " | " | " | " | " | " | " | " | " | Ni 0.28, Cu 0.16 Mo 0.12, REM 0.013 | " |
| Comparison | 9 | 0.05 | 0.36 | 1.51 | 0.001 | — | 0.018 | 12 | 0.018 | 38 | — | 0.005 |
| | 10 | 0.03 | 0.19 | 2.07 | 0.002 | 0.048 | 0.023 | — | 0.034 | 56 | V 0.057 | 0.004 |
| | 11 | 0.04 | 0.23 | 1.98 | 0.003 | 0.034 | — | 13 | 0.041 | 38 | — | −0.013 |
| | 12 | 0.02 | 0.26 | 1.52 | 0.001 | 0.043 | 0.022 | 11 | 0.023 | 45 | — | 0.007 |
| | 13 | " | " | " | " | " | " | " | " | " | — | " |
| | 14 | 0.03 | 0.30 | 2.07 | 0.002 | 0.025 | 0.016 | 11 | 0.024 | 64 | Ni 0.28, Cu 0.16 Mo 0.12 | −0.006 |

| | | Processing condition | | | | | | |
|---|---|---|---|---|---|---|---|---|
| | Heat No. | Heating temp. (°C.) | Rate of reduction below 900° C. (%) | Finishing temp. (°C.) | Cooling speed (°C./S) | Temp. to stop cooling (°C.) | Thickness after final rolling (mm) | Remarks |
| Inventive steel | 1 | 1150 | 75 | 720 | 23 | 25 | 20 | |
| | 2 | 1150 | 75 | 730 | 23 | 25 | 20 | |
| | 3 | 1200 | 75 | 800 | 30 | 420 | 16 | |
| | 4 | 1150 | 70 | 700 | 23 | 250 | 20 | Temperature at 500° C. × 3 min. |
| | 5 | 1150 | 75 | 695 | 18 | 25 | 20 | |
| | 6 | " | " | 690 | " | " | " | |
| | 7 | 1000 | 72 | 710 | 28 | 25 | 22 | |
| | 8 | 1000 | 68 | 705 | 12 | 100 | 32 | |
| Comparison | 9 | 1150 | 75 | 715 | 23 | 25 | 20 | |
| | 10 | 1150 | 75 | 720 | 23 | 120 | 20 | |
| | 11 | 1150 | 75 | 710 | 23 | 25 | 18 | |
| | 12 | 950 | 75 | 720 | 23 | 25 | 20 | |
| | 13 | 1150 | 75 | 720 | 6 | 25 | 20 | |
| | 14 | 1000 | 42 | 710 | 12 | 120 | 32 | |

| | | Properties of base metal Note (1) | | | | Property at welded portion Note (2) |
|---|---|---|---|---|---|---|
| | Heat No. | YS (kg/mm³) | TS (kg/mm³) | Note (3) 2vE-40 (kg-m) | Note (4) vTrs (°C.) | Note (5) (HAZ) vE-20 (kg-m) |
| Inventive steel | 1 | 41.3 | 63.9 | 39.3 | <−100 | 29.5 |
| | 2 | 42.9 | 65.2 | 25.7 | −100 | 21.2 |
| | 3 | 40.7 | 59.1 | 36.6 | −95 | 32.1 |
| | 4 | 59.7 | 77.2 | 19.4 | <−100 | 16.9 |
| | 5 | 52.4 | 74.0 | 27.3 | <−100 | 19.6 |
| | 6 | 59.4 | 81.1 | 24.9 | <−100 | 19.2 |
| | 7 | 52.4 | 76.3 | 18.0 | <−100 | 20.7 |
| | 8 | 55.1 | 72.8 | 21.9 | <−100 | 18.2 |
| Comparison | 9 | 38.6 | 57.4 | 4.9 | −50 | 24.9 |
| | 10 | 40.4 | 62.9 | 18.6 | <−100 | 22.8 |
| | 11 | 50.9 | 62.0 | 20.4 | <−100 | 8.2 |
| | 12 | 46.2 | 57.1 | 20.7 | <−100 | 29.1 |
| | 13 | 43.9 | 56.2 | 36.9 | <−100 | 27.6 |

TABLE-continued

| | | | | | | |
|---|---|---|---|---|---|---|
| | 14 | 54.4 | 74.2 | 4.1 | −80 | 19.1 |

Note:
Steels cooled down to "Temp. to stop cooling" were air-cooled except Heat No. 4.
Note (1)
Values measured in the direction normal to rolling.
Note (2)
Charpy Impact Value of the welded zone by submerged arc welding under heat input of 40–100 kJ/cm, measured at the notch located 1 mm away from the junction of weld metals deposited from opposite sides of the plate.
Note (3)
Absorbed energy at minus 40° C.
Note (4)
Transition temperature of 50% shear area.
Note (5)
Absorbed energy at minus 20° C.

What is claimed is:

1. A method of making wrought high tension steel having superior strength, toughness, and weldability which comprises the steps of:

preparing a steel consisting essentially by weight of; 0.005–0.12% C, not more than 0.6% Si, 0.6–1.4% Mn, not more than 0.005% S, 0.005–0.08% Al, 0.01–0.08% Nb, 0.0005–0.002% B, 0.004–0.03% Ti, not more than 0.006% N, at least one element by weight selected from the group consisting of; 0.01–0.08% V, 0.1–1.0% Ni, 0.1–1.0% Cu, 0.1–1.0% Cr, 0.05–0.3% Mo, 0.0005–0.005% Ca, and 0.001–0.03% in total of rare earth metal or metals, and the remainder being Fe and incidental impurities and the Ti and N contained in the steel satisfy the relationship expressed by a formula $$-0.01\% \leqq Ti - 3.4N \leqq 0.02\%;$$

heating the steel at a temperature within a range of 1,000°–1,200° C.;

rolling the steel with a rolling reduction of not less than 60% at a temperature range of not more than 900° C. and the temperature for terminating the rolling is kept within a range of 640°–850° C.;

cooling the steel, after it has been rolled down, to a pre-determined temperature lower than 550° C. with a cooling rate within a range of 10°–40° C./sec.

2. The method of claim 1 wherein the amount of Si is not more than 0.2%.

3. The method of claim 1 wherein the amount of S is not more than 0.001%.

4. The method of claim 1 wherein the steel further includes P in an amount of less than 0.030%.

5. The method of claim 4 wherein the amount of P is not more than 0.010%.

6. The method of claim 1 wherein the amount of Si is not more than 0.2%; and the amount of S is not more than 0.001%.

7. The method of claim 6 wherein the steel further includes P in an amount of less than 0.030%.

8. The method of claim 7 wherein the amount of P is not more than 0.010%.

9. The method of claim 1 wherein the steel is cooled after it has been rolled down to a predetermined temperature lower than 550° C. to about 350° C.

10. The method of claim 9 wherein the steel is air-cooled below about 350° C.

* * * * *